US010808969B2

(12) United States Patent
Vaidya et al.

(10) Patent No.: US 10,808,969 B2
(45) Date of Patent: Oct. 20, 2020

(54) SCREW COMPRESSOR ECONOMIZER PLENUM FOR PULSATION REDUCTION

(71) Applicant: Carrier Corporation, Jupiter, FL (US)

(72) Inventors: Amit Vaidya, Jamesville, NY (US); David M. Rockwell, Cicero, NY (US); Peter J. Pileski, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 319 days.

(21) Appl. No.: 15/737,076

(22) PCT Filed: Aug. 11, 2016

(86) PCT No.: PCT/US2016/046459
§ 371 (c)(1),
(2) Date: Dec. 15, 2017

(87) PCT Pub. No.: WO2017/027657
PCT Pub. Date: Feb. 16, 2017

(65) Prior Publication Data

US 2018/0156501 A1 Jun. 7, 2018

Related U.S. Application Data

(60) Provisional application No. 62/203,858, filed on Aug. 11, 2015.

(51) Int. Cl.
*F04C 29/12* (2006.01)
*F04C 18/16* (2006.01)
(Continued)

(52) U.S. Cl.
CPC ..... *F25B 9/145* (2013.01); *F04C 18/16* (2013.01); *F25B 1/10* (2013.01); *F25B 3/00* (2013.01);
(Continued)

(58) Field of Classification Search
CPC ..... F25B 45/00; F25B 1/047; F04C 29/12; F04C 18/16; F04C 29/0035; F04C 29/068
See application file for complete search history.

(56) References Cited

U.S. PATENT DOCUMENTS 3,568,466 A * 3/1971 Brandin et al. ..... F04C 29/0007 62/510
3,871,800 A 3/1975 Slayton
(Continued)

FOREIGN PATENT DOCUMENTS

CA 2197361 10/1997
CN 1212333 A 3/1999
(Continued)

OTHER PUBLICATIONS

International Search Report and Written Opinion dated Oct. 26, 2016 for PCT Patent Application No. PCT/US2016/046457.
(Continued)

*Primary Examiner* — Deming Wan
(74) *Attorney, Agent, or Firm* — Bachman & LaPointe, P.C.

(57) ABSTRACT

A compressor (22) has a male rotor (52), a female rotor (54), and a housing (50). The housing has a first bore (114) and a second bore (116) respectively accommodating portions of the male rotor and the female rotor. The housing has an inlet (26), an outlet (28), an economizer port (150) along at least one of the first bore and the second bore, and an external port (46) communicating with the economizer port. The housing has a chamber (152) between the economizer port and the external port having a volume of at least 0.8 liter.

21 Claims, 6 Drawing Sheets

(51) Int. Cl.

| | |
|---|---|
| ***F25B 1/047*** | (2006.01) |
| ***F25B 45/00*** | (2006.01) |
| ***F04C 29/00*** | (2006.01) |
| ***F25B 9/14*** | (2006.01) |
| ***F25B 1/10*** | (2006.01) |
| ***F25B 3/00*** | (2006.01) |
| ***F25B 39/04*** | (2006.01) |

(52) U.S. Cl.

CPC ..... *F25B 39/04* (2013.01); *F25B 45/00* (2013.01); *F25B 2400/13* (2013.01); *F25B 2500/12* (2013.01); *F25B 2500/13* (2013.01)

(56) References Cited

U.S. PATENT DOCUMENTS

| | | | | |
|---|---|---|---|---|
| 4,084,405 | A * | 4/1978 | Schibbye | F25B 1/047 62/197 |
| 4,934,482 | A | 6/1990 | Herron et al. | |
| 5,180,298 | A | 1/1993 | DiRe | |
| 5,205,719 | A | 4/1993 | Childs et al. | |
| 5,224,840 | A | 7/1993 | Dreiman et al. | |
| 5,507,151 | A | 4/1996 | Ring et al. | |
| 5,616,017 | A | 4/1997 | Iizuka et al. | |
| 6,095,777 | A | 8/2000 | Nishihata et al. | |
| 6,257,846 | B1 | 7/2001 | Muramatsu et al. | |
| 6,360,555 | B1 | 3/2002 | Li et al. | |
| 6,902,381 | B2 | 6/2005 | Hur et al. | |
| 7,121,814 | B2 | 10/2006 | Rockwell et al. | |
| 7,156,624 | B2 | 1/2007 | Shoulders | |
| 7,568,898 | B2 | 8/2009 | Shoulders | |
| 7,988,427 | B2 | 8/2011 | Patrick | |
| 7,993,112 | B2 | 8/2011 | Rockwell | |
| 8,016,071 | B1 | 9/2011 | Martinus et al. | |
| 8,021,126 | B2 | 9/2011 | Sishtla et al. | |
| 8,317,489 | B2 | 11/2012 | Barth | |
| 8,496,446 | B2 | 7/2013 | Lai | |
| 8,845,312 | B2 | 9/2014 | Takaki | |
| 2002/0051722 | A1* | 5/2002 | Okada | F04C 18/086 418/201.1 |
| 2003/0049146 | A1 | 3/2003 | Dieterich | |
| 2005/0144976 | A1 | 7/2005 | Sishtla | |
| 2006/0127235 | A1* | 6/2006 | Shoulders | F04C 18/086 417/310 |
| 2006/0165543 | A1 | 7/2006 | Fox et al. | |
| 2006/0239836 | A1 | 10/2006 | Forster | |
| 2007/0269325 | A1 | 11/2007 | Candio et al. | |
| 2008/0060622 | A1 | 3/2008 | Prior | |
| 2008/0219863 | A1 | 9/2008 | Jung | |
| 2008/0284161 | A1 | 11/2008 | Dole et al. | |
| 2010/0209280 | A1 | 8/2010 | Flannigan et al. | |
| 2010/0218536 | A1 | 9/2010 | Rockwell | |
| 2015/0004015 | A1 | 1/2015 | Kienzle et al. | |
| 2016/0097572 | A1 | 4/2016 | Feller et al. | |

FOREIGN PATENT DOCUMENTS

| | | | | |
|---|---|---|---|---|
| CN | 1221088 | A | 6/1999 | |
| CN | 2002/053975 | A1 | 7/2002 | |
| CN | 1499080 | A | 5/2004 | |
| CN | 1851244 | A | 10/2006 | |
| CN | 101072946 | A | 11/2007 | |
| CN | 101144475 | A | 3/2008 | |
| CN | 201462139 | U | 5/2010 | |
| CN | 102878366 | A | 1/2013 | |
| CN | 203404544 | U | 1/2014 | |
| CN | 103821713 | A | 5/2014 | |
| CN | 203822630 | U | 9/2014 | |
| CN | 104204532 | A | 12/2014 | |
| CN | 104411974 | A | 3/2015 | |
| DE | 10011023 | A1 | 9/2001 | |
| DE | 202005001600 | U1 | 4/2005 | |
| DE | 202007005097 | U1 | 8/2008 | |
| DE | 102013106344 | A1 | 12/2014 | |
| EP | 0542169 | A1 | 5/1993 | |
| EP | 0926414 | A2 | 6/1999 | |
| FR | 1339407 | A | 10/1963 | |
| GB | 282752 | A * | 5/1928 | F04C 18/126 |
| JP | 54129017 | U | 9/1979 | |
| JP | 57129286 | A | 8/1982 | |
| JP | H01237389 | A | 9/1989 | |
| JP | 07332267 | A | 12/1995 | |
| JP | 08338386 | A | 12/1996 | |
| JP | 2003184767 | A | 7/2003 | |
| RU | 2435985 | C2 | 12/2011 | |
| WO | 01/66946 | A1 | 9/2001 | |
| WO | 02/053917 | A1 | 7/2002 | |
| WO | 2008/045084 | A1 | 4/2008 | |
| WO | 2011/152915 | A2 | 12/2011 | |
| WO | 2015/006081 | A2 | 1/2015 | |

OTHER PUBLICATIONS

Anatomy of a Grooved Pipe Joint, Jan. 2010, Victaulic, Easton, Pennsylvania.

Seal Selection Guide Elastometric Seal Construction, Mar. 2016, Victaulic, Easton, Pennsylvania.

Aquaforce 30XW150-400 Water-Cooled Liquid Chillers, Installation Instructions, Jul. 2012, Carrier Corporation, Jupiter, Florida.

International Search Report and Written Opinion dated Oct. 21, 2016, for PCT Patent Application No. PCT/US2016/046516.

High Flow Compressor Outlet Pipe for Evo X Turbo, Jul. 23, 2014, BC, Canada, retrieved from Internet Mar. 22, 2018 https://www.exoticspeed.com/products/high-flow-compressor-outlet-pipe-for-evo-x-turbo, Exotic Speed.

Chinese Office Action dated Jan. 2, 2019 for Chinese Patent Application No. 201680047232.X.

Chinese Office Action dated Apr. 25, 2019 for Chinese Patent Application No. 201680056844.5.

European Office Action dated Feb. 20, 2019 for European Patent Application No. 16754377.6.

Russian Office Action dated Dec. 11, 2019 for Russian Patent Application No. 2018100095.

Fang Danqun, Aerodynamic Noise and Muffler, Aug. 31, 1978, pp. 140-146, Science Press, Beijing, China.

Chinese Office Action dated Nov. 29, 2018 for Chinese Patent Application No. 201680041008.X.

International Search Report and Written Opinion dated Oct. 13, 2016 for PCT Patent Application No. PCT/US2016/046459.

Russian Office action dated Mar. 25, 2020 for Russian Patent Application No. 2018100095.

* cited by examiner

SCREW COMPRESSOR ECONOMIZER PLENUM FOR PULSATION REDUCTION

CROSS-REFERENCE TO RELATED APPLICATIONS

Benefit is claimed of U.S. Patent Application No. 62/203,858, filed Aug. 11, 2015, and entitled "Screw Compressor Economizer Plenum for Pulsation Reduction", the disclosure of which is incorporated by reference herein in its entirety as if set forth at length.

BACKGROUND

The disclosure relates to compressors. More particularly, the disclosure relates to economized compressors.

Positive displacement compressors such as screw compressors are commonly used in applications such as chillers. Many such compressors are economized, having an economizer port intermediate to a suction port and discharge port. In the operation of a chiller compressor, economizer flow is bypassed from the main flow and is used to absorb heat from the main flow prior to returning to the economizer port. This expands the envelope of compressor and system operation.

A notable problem with such compressors is the propagation of pulsation from the economizer port. The opening and closing of compression pockets to the economizer port causes a pulsation which propagates upstream along the economizer flowpath exciting the system and producing annoying sound and unwanted vibration.

To address such sound and vibration, various measures may be taken including adding mufflers along the economizer line and adding sound damping material along the economizer line and/or compressor housing. US Patent Application Publication 2006/0127235A1 of Shoulders, published Jun. 15, 2006, discloses the formation of resonators along the economizer flowpath within the housing of the compressor to produce cancelling pulsation.

SUMMARY

One aspect of the disclosure involves a compressor having a male rotor, a female rotor, and a housing. The housing has a first bore and a second bore respectively accommodating portions of the male rotor and the female rotor. The housing has an inlet, an outlet, an economizer port along at least one of the first bore and the second bore, and an external port communicating with the economizer port. The housing has a chamber between the economizer port and the external port having a volume of at least 0.8 liter.

In one or more embodiments of any of the foregoing embodiments, the volume is at least 1.0 liters.

In one or more embodiments of any of the foregoing embodiments, the volume is 1.0 liters to 2.0 liters.

In one or more embodiments of any of the foregoing embodiments, the volume is 1.10 liters to 1.50 liters.

In one or more embodiments of any of the foregoing embodiments, the volume is at least 30% of a displacement per revolution of the male rotor.

In one or more embodiments of any of the foregoing embodiments, the displacement per revolution of the male rotor is 1.0 liter to 5.0 liters.

In one or more embodiments of any of the foregoing embodiments, an area ratio of the economizer port to the external port is at least 0.130 and at most 0.170.

In one or more embodiments of any of the foregoing embodiments, the compressor is a two-rotor compressor.

In one or more embodiments of any of the foregoing embodiments, the compressor further comprises: a motor within the housing directly driving the male rotor.

In one or more embodiments of any of the foregoing embodiments, the economizer port is along the second bore and not the first bore.

In one or more embodiments of any of the foregoing embodiments, the chamber has a protuberant portion.

In one or more embodiments of any of the foregoing embodiments, at a first location the protuberant portion has a minimum cross-sectional area of at least twice an area of the external port.

In one or more embodiments of any of the foregoing embodiments, a cut plane through the protuberant portion parallel to a central axis of the at least one of the first bore and second bore has an area at least three times a cross-sectional area of a passageway leg to the external port and/or at least eight times a cross-sectional area of a passageway leg to the economizer port.

In one or more embodiments of any of the foregoing embodiments, a portion of the chamber has a surface portion opening to the economizer port and generally radially outwardly convex relative to an axis of said at least one of the first bore and second bore.

In one or more embodiments of any of the foregoing embodiments, a method for using the compressor comprises: driving rotation of the male rotor and female rotor to: intake a first flow of fluid through the inlet, compress the first flow and discharge the first flow from the outlet; and intake an additional flow of fluid through the economizer port to merge with the first flow.

In one or more embodiments of any of the foregoing embodiments, the chamber is effective to provide pulsation transmission loss of at least 3 dB rms over a majority of a male rotor speed range of 60 Hz to 105 Hz.

In one or more embodiments of any of the foregoing embodiments, the chamber is effective to provide pulsation transmission loss of at least 5 dB rms over a majority of said speed range.

Another aspect of the disclosure involves a vapor compression system comprising the compressor and further comprising: a first heat exchanger; a second heat exchanger; a flowpath passing from the compressor outlet through the first heat exchanger and then the second heat exchanger and then returning to the compressor inlet; and an economizer flowpath branching from the flowpath and returning to the external port.

In one or more embodiments of any of the foregoing embodiments, the vapor compression system further comprises: an economizer along the economizer flowpath.

In one or more embodiments of any of the foregoing embodiments, the economizer comprises a heat exchanger with a first leg along the flowpath and a second leg along the economizer flowpath and in heat exchange relation with the first leg.

Another aspect of the disclosure involves a compressor comprising: a male rotor and a female rotor; and housing. The housing has: a first bore and a second bore respectively accommodating portions of the male rotor and the female rotor; an inlet; an outlet; an economizer port along at least one of the first bore and the second bore; an external port communicating with the economizer port; and means between the economizer port and the external port for dissipating pulsations propagating from the economizer port.

The details of one or more embodiments are set forth in the accompanying drawings and the description below.

Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 2:
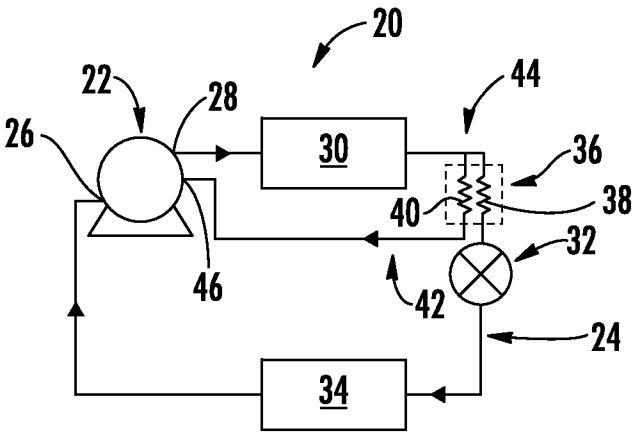
FIG.2 (PRIOR ART)
FIG. 2 is a schematic view of a vapor compression system.

FIG. 2 shows a vapor compression system 20 having a compressor 22 along a recirculating refrigeration flowpath 24. The exemplary system 20 is a most basic system for purposes of illustration. Many variations are known or may yet be developed. Along the flowpath 20, the compressor 22 has a suction port (inlet) 26 and a discharge port (outlet) 28. In a normal operational mode, refrigerant drawn in via the suction port 26 is compressed and discharged at high pressure from the discharge port 28 to proceed downstream along the flowpath 24 and eventually return to the suction port. Sequentially from upstream to downstream along the flowpath 24 are: a heat exchanger 30 (in the normal mode a heat rejection heat exchanger); an expansion device 32 (e.g., an electronic expansion valve (EXV) or a thermal expansion valve (TXV)); and a heat exchanger 34 (in the normal mode a heat absorption heat exchanger). The exchangers may, according to the particular task involved, be refrigerant-air heat exchangers, refrigerant-water heat exchangers, or other variants.

The exemplary system 20 is an economized system having an economizer heat exchanger 36. The exemplary economizer heat exchanger 36 (e.g., a brazed plate heat exchanger) has a first leg 38 along the main refrigerant flowpath. The economizer further includes a second leg 40 in heat exchange relation with the first leg 38 along an economizer flowpath 42 branching off the main flowpath. The economizer flowpath 42 enters the associated economizer line and extends from junction 44 with the main flowpath to an economizer port 46 of the compressor. An alternative economizer configuration is a flash tank economizer.

Figure 3:
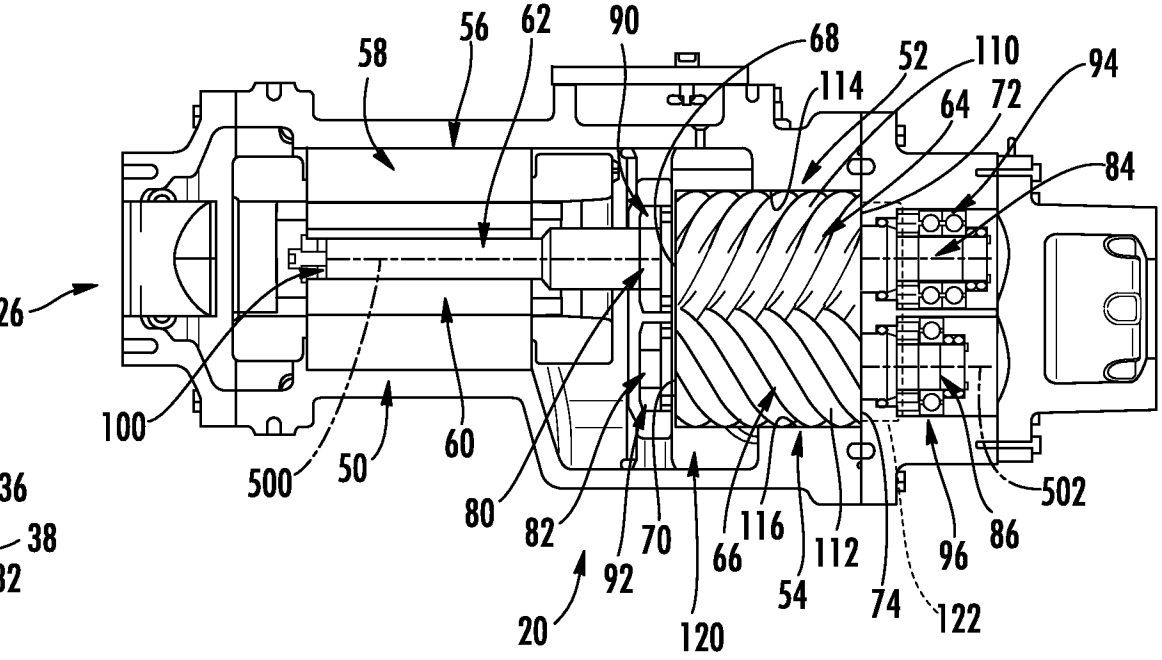
FIG. 3 is a second axial cutaway view of the compressor.

FIG. 3 shows the compressor 20 as a positive displacement compressor, namely twin-rotor screw compressor having a housing assembly (housing) 50. The compressor has a pair of rotors 52 (male), 54 (female) discussed in further detail below. The exemplary compressor is a semi-hermetic compressor wherein an electric motor 56 is within the housing assembly and exposed to the refrigerant flowing between the suction port 26 and discharge port 28. The exemplary motor comprises a stator 58 fixedly mounted within the housing and a rotor 60 mounted to a shaft portion 62 of the first rotor 52.

Each of the rotors 52, 54 has a lobed working portion or section 64, 66 extending from a first end 68, 70 to a second end 72, 74. The rotors include shaft portions 80, 82 protruding from the first ends and 84, 86 protruding from the second ends. The shaft portions may be mounted to bearings 90, 92, 94, and 96. The bearings support the respective rotors for rotation about respective axes 500, 502 (FIG. 3) parallel to each other. The exemplary shaft portion 62 is located distally of the shaft portion 80 and extends to an end 100. The exemplary shaft portion 62 lacks any additional bearing support so that the motor rotor 60 is held cantilevered from the bearing 90.

The respective rotor working portions 64, 66 have lobes 110, 112 enmeshed with each other. The rotor lobes combine with housing bores 114, 116 receiving the respective rotors to form compression pockets. In operation, the compression pockets sequentially open and close at a suction plenum 120 and at a discharge plenum 122. This opening/closing action serves to draw fluid in through the inlet 26, then to the suction plenum, then compress the fluid and discharge it into the discharge plenum, to in turn pass to the outlet. The fluid drawn in through the suction port 26 may pass through/around the motor so as to cool the motor before reaching the suction plenum.

Figure 1:
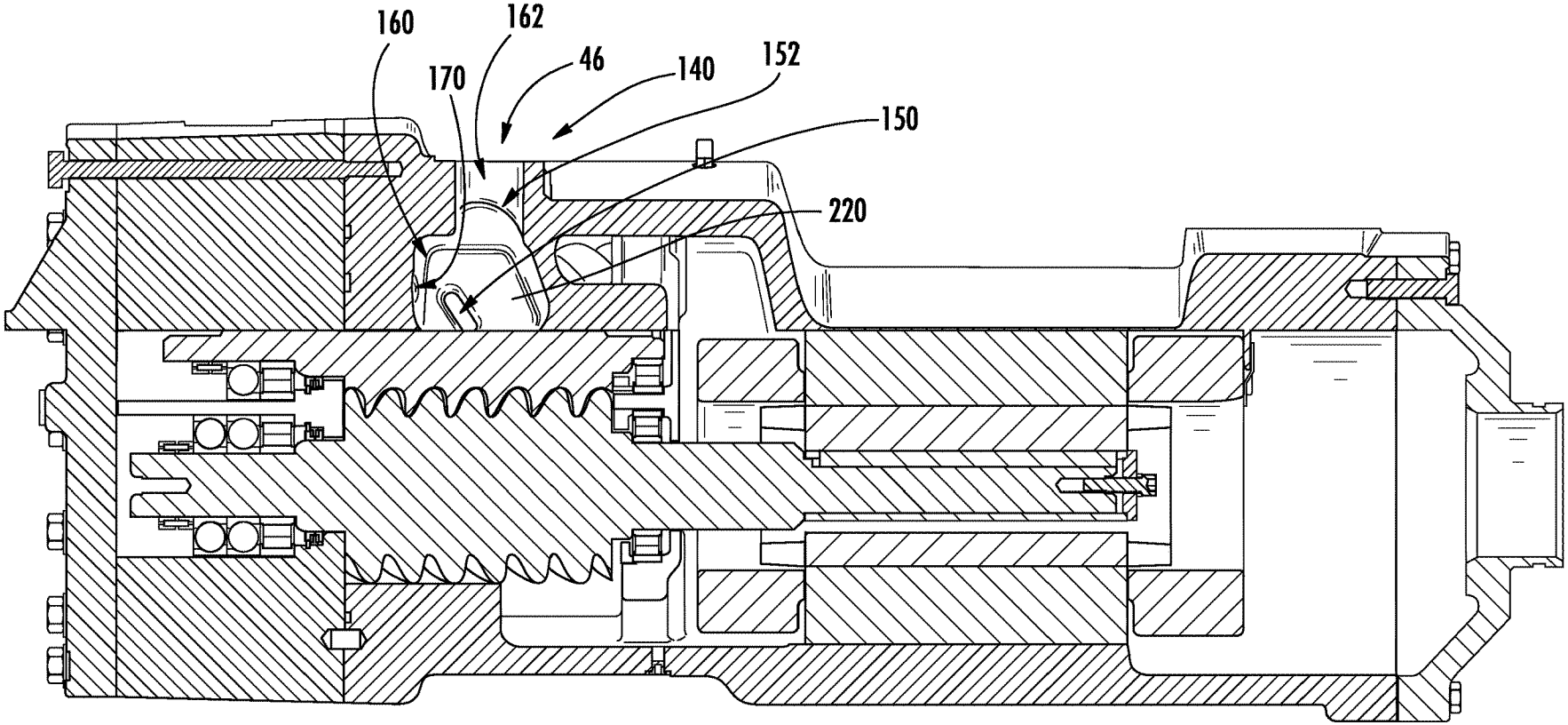
FIG. 1 is a first axial cutaway view of a twin-rotor screw compressor.

FIG. 1 shows the economizer port 46 being provided by a fitting 140 on the exterior of the housing. For purposes of discussion, the term "economizer port" may alternatively refer to the port on the exterior of the housing associated with the fitting or may refer to a port 150 along the interior of the housing (i.e., along the surface of the bore (s) accommodating one or more rotors). FIG. 3 shows a plenum (economizer plenum) 152 forming a passageway between the external economizer port 140 and the internal or interior economizer port 150. The exemplary internal economizer port 150 is along the bore of a single one of the rotors and becomes exposed to a compression pocket during an intermediate stage of compression.

In operation, the motor directly drives the male rotor. The interaction of the male rotor lobes with the female rotor lobes, in turn, drives rotation of the female rotor. Alternative compressors may have other drive arrangements such as reducing gearboxes. For an exemplary air-cooled compressor with R134A refrigerant, exemplary basic full-load compressor volume index is 3.35 or 2.7, more broadly, 1.7 to 4.0 or 2.0 to 4.0 or 2.5 to 3.5. For a variable capacity compressor, one or more unloading and/or volume index (VI) valves may be used to reduce compression below such basic full-load values. The exemplary motor is an induction motor. An exemplary induction motor is a two-pole motor.

The opening of the compression pockets at the internal economizer port 150 produces a pulsation. For example, when a compression pocket just begins to open to the internal economizer port 150 the pressure in the pocket may be less than the pressure in the economizer line. Consequently refrigerant flow rushes into the compression pocket from the economizer line. As the pocket crosses over the internal economizer port, the pressure in the compression pocket rises above the pressure in economizer line causing the gas to rush out of the compression pocket through the internal economizer port 150. This movement of gas in and out of the compression pocket causes pulsation in the economizer passageway 152. The pulsation will propagate back upstream along the economizer branch 42. The pulsation may thus produce annoying sound and may also produce equipment-damaging vibration.

In order to help dissipate the vibration before exiting the compressor, FIG. 1 shows the passageway 152 as including an enlarged area or region 160. Thus, the exemplary passageway 152 includes, adjacent the external economizer port 46, a region 162 of the exemplary circular cross-section associated with the nominal size of refrigerant line used to form the economizer line. The passageway 152 then expands forming the region 160 off of which a short leg 164 (FIG. 4) to the internal port 150 extends.

Table I below shows the exemplary properties of exemplary compressors and exemplary cavities. Compressors are nominally sized via a frame number with increasing number associated with increasing size. The second column of Table I identifies the properties of exemplary size of two-rotor compressors, exemplary size measured as cubic feet per revolution which identifies the volume of intake fluid per revolution of the male rotor. The third column identifies the total cavity volume of the passageway 152. As is discussed below, this may include a dead leg or branch 170 (FIG. 5) which may represent an artifact of manufacture. The fourth column is the area of the internal economizer port 150. The fifth column is the area of the external economizer port (e.g., the cross-sectional diameter in the region 162). The final column is the ratio of these areas.

TABLE I

| Nominal Size | Displacement ft.$^3$/rev. (l/rev.) | Cavity Volume (in$^3$ ((l)) | Port Area (mm$^2$) | Inlet Area (mm$^2$) | Area Ratio |
|---|---|---|---|---|---|
| Frame 1 | 0.05 (1.3) | 68.5 (1.1) | 410 | 2827 | 0.15 |
| Frame 2 | 0.08 (2.4) | 72.0 (1.2) | 440 | 2827 | 0.16 |
| Frame 3 | 0.14 (4.0) | 87.5 (1.4) | 450 | 2827 | 0.16 |

The exemplary Frame 1, 2, and 3 cavities are representative of tested examples and are not limiting at to particular geometry. Cavity volume may be sufficiently large so to provide space for pulsation waves to spread out and be broken up by reflection and the like. There may become diminishing marginal returns above a threshold volume which are then overwhelmed by cost issues. An exemplary volume is at least 0.8 liters, or at least 1.0 liter or 1.0 liter to 2.0 liters or 1.10 to 1.50 liters.

As an example of relative size, the volume may be at least 30% of a displacement per revolution of the male rotor. However, testing reflected in the table above shows relative insensitivity of sufficient cavity size to compressor size. Such exemplary sizes include displacements of an exemplary one liter to five liters.

Exemplary compressor speeds are characterized by the rotational speed of the male rotor (e.g., in Hz). Pulsation frequency will reflect a combination of that speed and the lobe count, but there normally is only a slight variation in lobe count with most compressors having between 5 and 8 lobes on their male rotors. With variable speed drive, an exemplary baseline compressor may have an operational range of 45 Hz to 90 Hz. Pulsations generally are not problems in the lower portion of this range (e.g., below 60 Hz).

Figure 4:
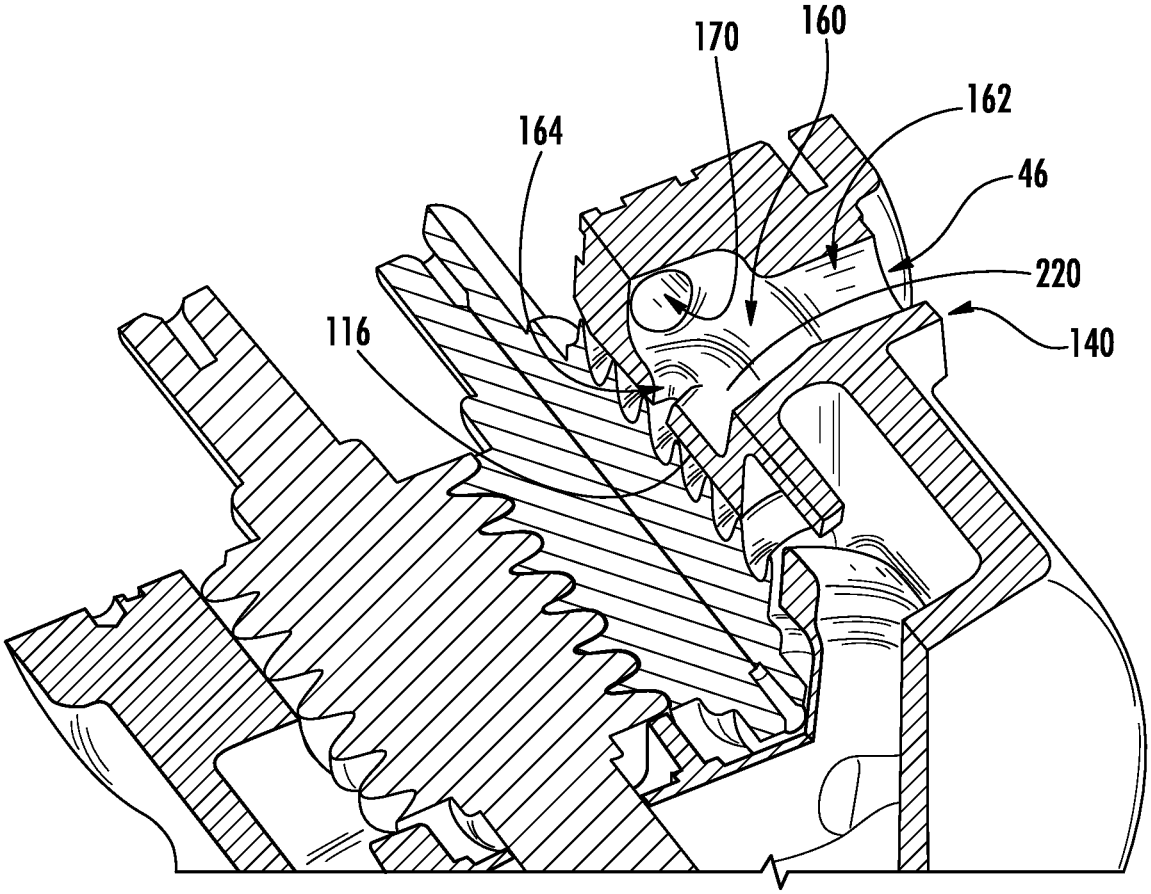
FIG. 4 is a partial compound cutaway view of the compressor showing the female rotor cutaway at the compound angle relative to the housing to expose an economizer passageway.
Figure 5:
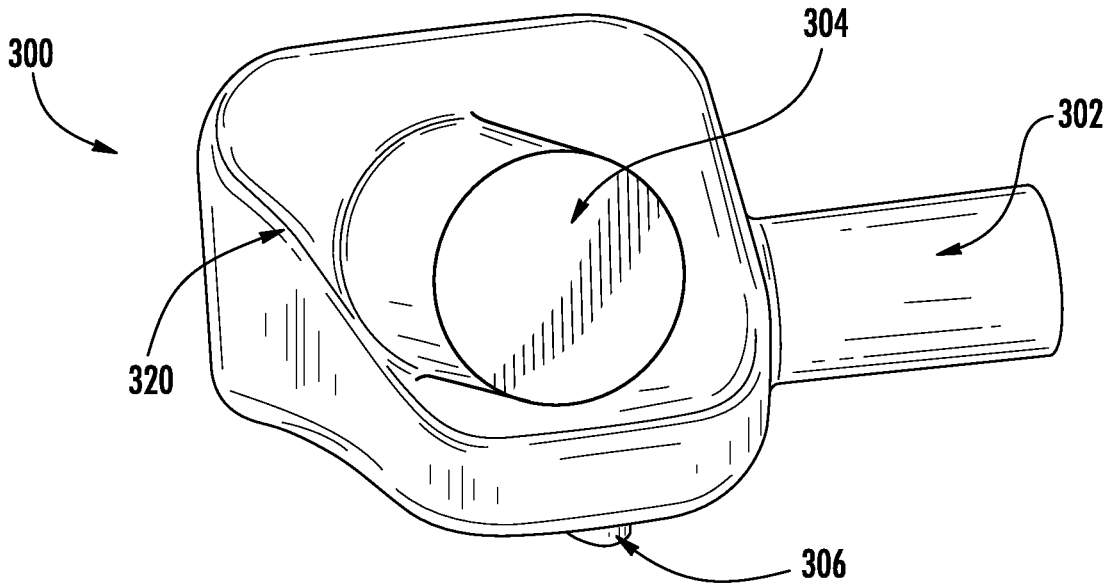
FIG. 5 is a view of a core for casting the economizer passageway.

FIGS. 4 and 5 show further details of the economizer passageway 152 and a core for casting it. The passageway is shown having the dead leg 170 branching off the main portion of the passageway (i.e., branching off a path extending from the external economizer port 46 to the internal economizer port 150). The dead leg 170 is an artifact of the casting process and is cast by a branch 302 (FIG. 5) of a casting core 300. The branch 302 serves to register/retain the casting core in a mold or shell (not shown) during the casting process. The exemplary casting core 300 further comprises a branch 304 positioned in dimensions to cast the region 162. The core 300 further includes a branch 306 positioned to cast the passageway leg leading to the internal economizer port 150 from the region 160. A central protuberance 320 (off of which the legs 302, 304 and 306 extend) is dimensioned to cast the region 160. In the casting process, the branch 304 ends up protruding from a discharge end face of the rotor case and the leg 170 it casts is closed by the bearing case.

The protuberant nature of the region 160 may help cause partial wave reflections that dissipate the output pulses at the external port relative to the internal port. In one characterization of the protuberant nature of the volume of the region 160, at a first location the protuberant portion has a minimum cross-sectional area of at least twice an area of the external port or at least 3.0 times. That minimum cross-sectional area is defined by pinning a hypothetical plane at a given point in space (the location) in the region 160. The area of the region 160 cut by the plane will vary depending on plane orientation. The first location may thus be selected to provide the maximum value of that minimum.

Figure 6:
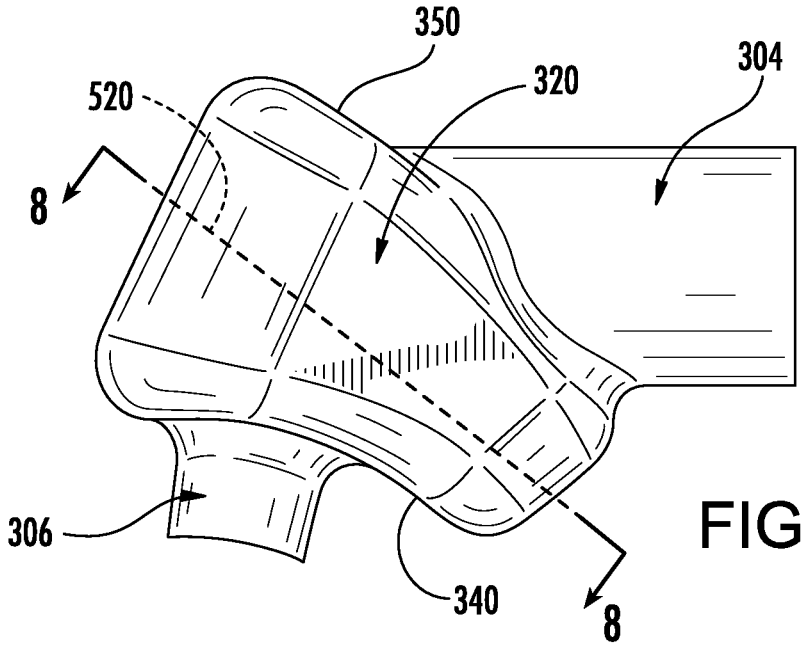
FIG. 6 is a second view of the core.
Figure 7:
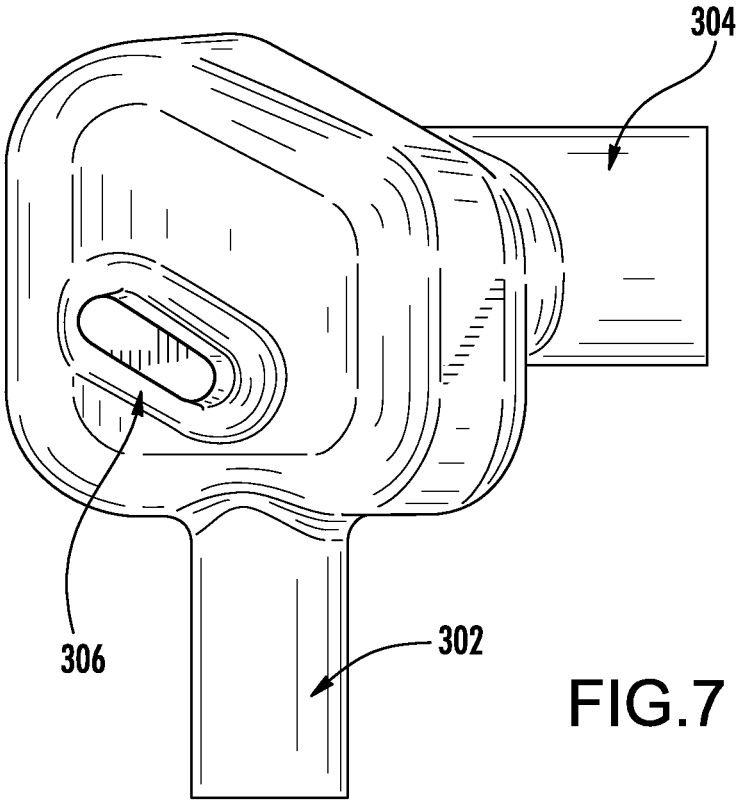
FIG. 7 is a third view of the core.

FIG. 6 shows the protuberance 320 as having a concave surface portion 340 complementary to the associated rotor bore. The surface portion 340 casts a corresponding surface portion 220 (FIG. 1) of the region 160. The surface portion 220 is thus essentially concentric/coaxial with the associated rotor bore 116. The concavity of the surface portion 340 (inward convexity of the surface portion 220) helps increase or maximize the volume of the region 160. The branch 306 extends from the surface portion 340 so that a corresponding passageway section extends from the surface portion 220 of the region 160 to the internal economizer port 150. Thus, the concavity of the surface portions 340 and 220 is generally concentric with the axis 502 of the associated rotor.

Figure 8:
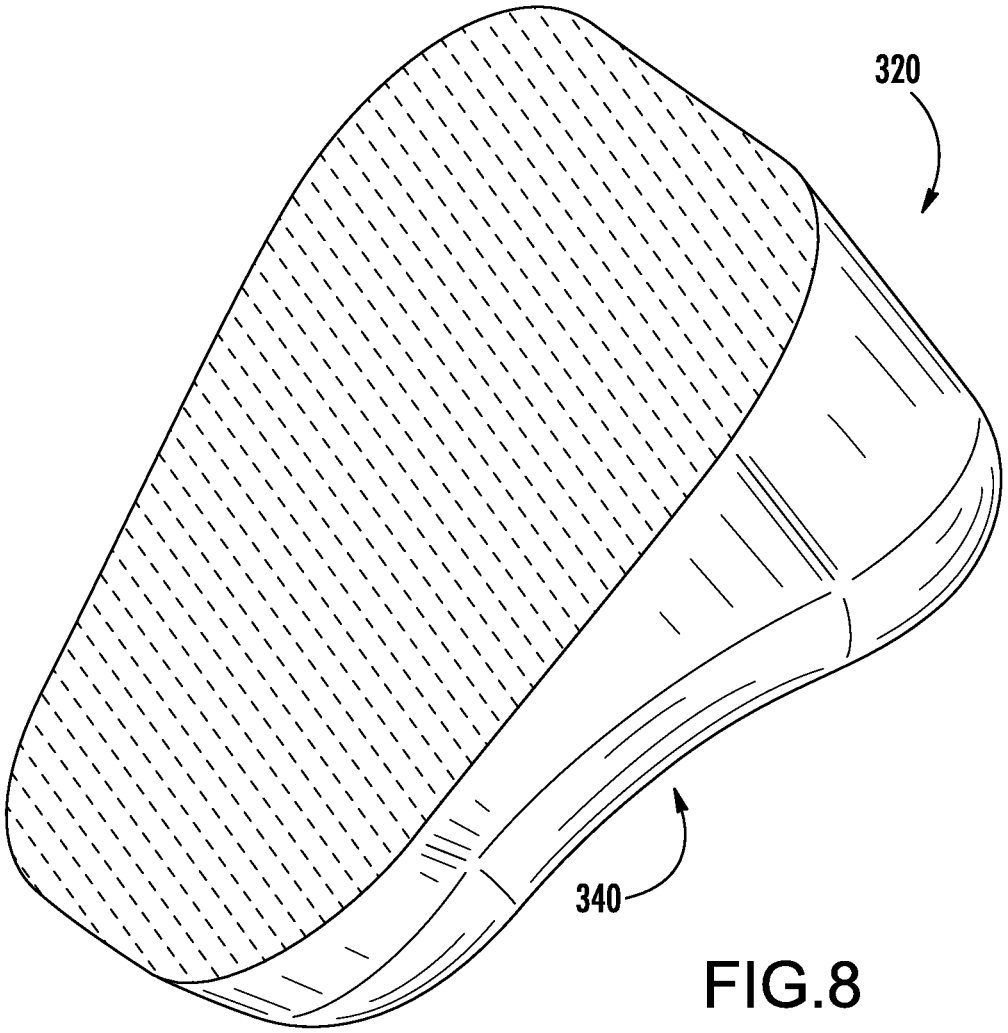
FIG. 8 is a partial cutaway view of the core (omitting branches) taken along line 8-8 of FIG. 6.

In a further example, a cut plane 520 is shown in FIG. 6 through the protuberance 320 (and thus region 160). The plane 520 is parallel to the rotor axes and approximately bisects centerlines of the internal economizer port and external economizer port branches 306, 304. FIG. 8 shows a cut along this plane. The surface area of this exemplary cut (cross-sectional area at the plane 520) is substantially greater than the cross-sectional areas of the internal economizer port or external economizer port or the branches 304, 306 away from the protuberance 320. In the illustrated example, this cross-sectional area is shown as just over four times the cross-sectional area of the branch 304 and associated passageway branch to the external economizer port 46. More broadly, the area may be at least three times the area of the branch 304 or an exemplary three times to eight times or three times to six times. Relative to the internal economizer port 150 area and the area of its passageway branch or core leg 306, the area along the cut plane 520 may be substantially greater. In the illustrated example, it is nearly thirty times greater. An exemplary ratio has the cross-sectional area at plane 520 being at least eight times the cross-sectional area of the internal economizer port or its passageway leg or at least fifteen times or at least twenty times or at least twenty-five times (e.g., up to fifty times or more).

Other characterizations, may involve comparing the cross-sectional areas of the branches 304 and 306 (and their associated passageway legs) to the surface areas where they intersect the protuberance 320 and region 160. For the branch 306, this may involve comparison to the concave surface portion 340. The ratio may be an exemplary at least five times or an exemplary at least eight times or substantially more. Similarly, for the branch 304, it merges with a generally flat region 350 (FIG. 6) which may have an area at least 2.5 times that of the cross-sectional area of the branch. For this purpose, the portions of the surfaces occupied by the intersection with the branches are included in their areas. Similarly, the areas of the branches are essentially normal to their centerline. Thus, the area of the branch 304 is its exemplary circular cross-section rather than the tilted approximately elliptical cross-section at the intersection with the surface 350.

The pulsation cancellation may expand the compressor operational envelope. For example, with the baseline compressor noted above having an operational range of 45 Hz to 90 Hz, the upper end may be pulsation-limited. The cancellation may expand the usable upper limit to an exemplary 105 Hz or above (e.g., 120 Hz, 130 Hz, 150 Hz or more). Compared to the baseline lacking the enlarged passageway, the revision may be effective to provide pulsation transmission loss of at least 3 dB or at least 5 dB over a majority (or more such as 75%) of a sensitive portion of the male rotor speed range (e.g., a majority of the of 60 Hz to 105 Hz range or substituting lower limits of 70 hz or 80 Hz and any of the upper limits noted above). The pulsations and their reduction may be measured by a dynamic pressure transducer in the economizer line (e.g., close to the economizer port). Resonances or other happenstance my mean that at some locations in that range the revision might not reduce the transmission and might increase it.

The compressor may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A compressor (22) comprising:
a male rotor (52) and a female rotor (54); and
a housing (50) having:
a first bore (114) and a second bore (116) respectively accommodating portions of the male rotor and the female rotor;
an inlet (26);
an outlet (28);
an economizer port (150) along at least one of the first bore and the second bore;
an external port (46) communicating with the economizer port; and
a chamber (152) between the economizer port and the external port having a volume of at least 0.8 liter, wherein:
the chamber has a protuberant portion (160); and
at a first location the protuberant portion has a minimum cross-sectional area of at least twice an area of the external port.

2. The compressor of claim 1 wherein:
the volume is at least 1.0 liters.

3. The compressor of claim 1 wherein:
the volume is 1.0 liters to 2.0 liters.

4. The compressor of claim 1 wherein:
the volume is 1.10 liters to 1.50 liters.

5. The compressor of claim 1 wherein:
the volume is at least 30% of a displacement per revolution of the male rotor.

6. The compressor of claim 5 wherein:
the displacement per revolution of the male rotor is 1.0 liter to 5.0 liters.

7. The compressor of claim 1 wherein:
an area ratio of the economizer port to the external port is at least 0.130 and at most 0.170.

8. The compressor of claim 1 wherein:
the compressor is a two-rotor compressor.

9. The compressor of claim 1 further comprising:
a motor within the housing directly driving the male rotor.

10. The compressor of claim 1 wherein:
the economizer port is along the second bore and not the first bore.

11. The compressor of claim 1 wherein:
a cut plane through the protuberant portion parallel to a central axis of the at least one of the first bore and second bore has an area at least three times a cross-sectional area of a passageway leg to the external port (46) and/or at least eight times a cross-sectional area of a passageway leg to the economizer port (150).

12. The compressor of claim 1 wherein:
a portion (160) of the chamber has a surface portion (220) opening to the economizer port (150) and generally radially outwardly convex relative to an axis of said at least one of the first bore and second bore.

13. A method for using the compressor of claim 1, the method comprising:
driving rotation of the male rotor and female rotor to:
intake a first flow of fluid through the inlet, compress the first flow and discharge the first flow from the outlet; and
intake an additional flow of fluid through the economizer port to merge with the first flow.

14. The method of claim 13 wherein:
the chamber is effective to provide pulsation transmission loss of at least 3 dB rms over a majority of a male rotor speed range of 60 Hz to 105 Hz.

15. The method of claim 14 wherein:
the chamber is effective to provide pulsation transmission loss of at least 5 dB rms over a majority of said speed range.

16. A vapor compression system (20) comprising the compressor of claim 1 and further comprising:
a first heat exchanger (30);
a second heat exchanger (34);
a flowpath passing (24) from the compressor outlet through the first heat exchanger and then the second heat exchanger and then returning to the compressor inlet; and
an economizer flowpath (42) branching from the flowpath and returning to the external port.

17. The vapor compression system of claim 16 further comprising:
an economizer (36) along the economizer flowpath.

18. The vapor compression system of claim 17 wherein:
the economizer comprises a heat exchanger with a first leg (38) along the flowpath and a second leg (40) along the economizer flowpath and in heat exchange relation with the first leg.

19. A compressor (22) comprising:
a male rotor (52) and a female rotor (54); and
a housing (50) having:
a first bore (114) and a second bore (116) respectively accommodating portions of the male rotor and the female rotor;
an inlet (26);
an outlet (28);
an economizer port (150) along at least one of the first bore and the second bore;
an external port (46) communicating with the economizer port; and
a chamber (152) between the economizer port and the external port having a volume of at least 0.8 liter, wherein:
the chamber has a protuberant portion (160); and
a cut plane through the protuberant portion parallel to a central axis of the at least one of the first bore and second bore has an area at least three times a cross-sectional area of a passageway leg to the external port (46) and/or at least eight times a cross-sectional area of a passageway leg to the economizer port (150).

20. The compressor of claim 19 wherein:
the compressor is a two-rotor compressor; and
a motor is within the housing directly driving the male rotor.

21. A compressor (22) comprising:
a male rotor (52) and a female rotor (54); and
a housing (50) having:
a first bore (114) and a second bore (116) respectively accommodating portions of the male rotor and the female rotor;
an inlet (26);
an outlet (28);
an economizer port (150) along at least one of the first bore and the second bore;
an external port (46) communicating with the economizer port; and
a chamber (152) between the economizer port and the external port having a volume of at least 0.8 liter, wherein: an area ratio of the economizer port to the external port is at least 0.130 and at most 0.170.

* * * * *